US007156334B1

(12) United States Patent
Fore, Sr. et al.

(10) Patent No.: US 7,156,334 B1
(45) Date of Patent: Jan. 2, 2007

(54) PAY-OUT TUBE

(75) Inventors: James R. Fore, Sr., Canton, NC (US); James R. Fore, II, Canton, NC (US); Lloyd Young, Candler, NC (US)

(73) Assignee: X-Spooler, Inc., Canton, NC (US)

( * ) Notice: Subject to any disclaimer, the term of this patent is extended or adjusted under 35 U.S.C. 154(b) by 796 days.

(21) Appl. No.: 10/086,316

(22) Filed: Mar. 1, 2002

(51) Int. Cl.
*B65H 49/02* (2006.01)
*B65H 55/00* (2006.01)
*B65H 57/12* (2006.01)

(52) U.S. Cl. ..... 242/171; 242/566; 242/580; 242/587.3

(58) Field of Classification Search ..... 242/171, 242/172, 476, 566, 580, 587.2, 587.3, 419.4, 242/157 R; 206/409
See application file for complete search history.

(56) References Cited

U.S. PATENT DOCUMENTS 3,516,111 A * 6/1970 Heyman ..... 16/2.1
4,057,203 A * 11/1977 Newman et al. ..... 242/171 X
4,274,607 A * 6/1981 Priest ..... 242/157 R X
5,115,995 A * 5/1992 Hunt ..... 242/157 R
5,150,852 A * 9/1992 Hunt et al. ..... 242/157 R
5,152,476 A * 10/1992 Moser ..... 242/157 R
5,368,245 A * 11/1994 Fore ..... 242/157 R
5,520,347 A * 5/1996 Bass et al. ..... 242/157 R
5,810,272 A * 9/1998 Wallace et al. ..... 242/157 R
6,341,741 B1 * 1/2002 Kotzur et al. ..... 242/171 X

* cited by examiner

*Primary Examiner*—Kathy Matecki
*Assistant Examiner*—Scott Haugland
(74) *Attorney, Agent, or Firm*—Coats & Bennett, P.L.L.C.

(57) ABSTRACT

A pay-out tube adapted to be used in conjunction with a capable container for directing cable from a winding disposed within the container. The pay-out tube includes a molded tube for receiving and guiding cable from the interior of the cable container and includes a surrounding wall having a series of spaced-apart ribs integrally molded into the wall and extending from the wall such that the thickness of the individual rigs exceed the thickness of the wall. Further, the pay-out tube includes a cable retainer including a surface having at least one slit formed therein that defines two sections, at least one section being deflectable and which opens in response to a cable end being inserted between the two sections, permitting the cable to move between the two sections and be held by the two sections.

20 Claims, 5 Drawing Sheets

PAY-OUT TUBE

FIELD OF INVENTION

The present invention relates to a pay-out tube used in conjunction with cable boxes and containers for facilitating the feeding of cable, wire and other flexible rope-like materials from such boxes and containers.

BACKGROUND OF THE INVENTION

It is customary in the manufacturing and preparation for shipment and subsequent handling of cable to wind the cable using an overlapping FIG. 8 pattern which results in a radial opening through the completely-formed cable winding. The FIG. 8 winding procedure provides for the end of the cable disposed interiorly of the winding to be directed from inside the winding through the radial opening formed in the winding and dispensed from the winding in a generally smooth process which provides the cable in a fashion easily presentable for installation to the appointed situation.

To facilitate storage, shipping, and handling, such windings are typically housed within a cardboard or similar container which has an opening formed in one wall. The winding is placed in the container in an orientation where the axis of the radial opening intersects the opening in the wall of the container and is generally perpendicular to the wall containing the opening. The pay out end of the cable is directed out the opening in the container wall thus providing for dispensing the cable.

The pay-out tube is generally inserted radially into the radial opening of the winding itself in order to tend to prevent the opening from collapsing during handling and storage and as the cable is progressively dispensed. The pay-out tube is also coupled to the container so as to be generally perpendicular to the wall of the container in which the opening is located and fully engaged, fastened to, and coaxial with said opening in the container wall. With this arrangement, the interior end of the cable can be threaded through the pay-out tube, entering the tube at the end interior to the winding and being pulled through the outside end of the tube and out of the container. The tube functions as a guide that facilitates the uncoiling of the cable loops so that the cable may be dispensed in a fashion ready for application.

Pay-out tubes are commonly used in the cable industry. For a basic understanding of the state-of-the-art with respect to pay-out tubes one is referred to the following U.S. Pat. Nos. 4,022,300; 4,057,203; 4,274,607; 5,042,739; 5,064,136; 5,150,852; 5,115,995; 5,152,476; 4,373,687; and, 5,368,245.

Known pay-out tube designs have various drawbacks and disadvantages. First, many pay-out tubes are difficult to install and attach to the container opening. Second, many conventional pay-out tubes provide no means of retaining and holding the terminal end of the cable once pulled from the winding, and they thus allow the terminal end of the cable to hang free and uncontrolled such that often the terminal end of the cable inadvertently retracts within the winding in the container requiring a difficult procedure to extract it. Third, conventional pay-out tubes have a tendency to become crushed or distorted in handling and usage, thereby compromising the uncoiling and dispensing function normally provided. Fourth, although the FIG. 8 winding pattern is designed to reduce the tendency for pigtailing during the dispensing operation, cable variations that may occur during manufacturing, occasional winding irregularities that may occur in the production of the winding, and winding shifts that may occur during storage and handling sometimes result in failures to fully uncoil during the dispensing operation, resulting in an interruption of the process of dispensing the cable by pigtailing and/or in the development of damaging kinks in the cable.

Therefore, there is and continues to be a need for a cable container pay-out tube that is easy to install, provides an convenient and reliable means of retaining the terminal end of the cable, and facilitates a smooth and obstruction-free cable dispensing operation.

SUMMARY OF THE INVENTION

The present invention relates to a pay-out tube that is utilized within a cable container for directing cable from the container, through the pay-out tube and out the container. The pay-out tube includes a molded tube portion having a surrounding wall that includes a series of spaced-apart ribs integrally molded into the wall and extending from the wall such that the thickness of the individual ribs exceeds the thickness of the wall.

In a particular embodiment of the present invention, the pay-out tube includes a generally elliptically-shaped tube having a major axis, a minor axis, an outlet end portion and an inlet end portion. The spaced-apart reinforcing ribs are integrally formed in the inlet end portion of the tube and generally aligned with the major and minor axises of the tube. In one particular design, each rib assumes a longitudinal configuration and projects towards the outlet end portion of the tube.

The present invention further comprises a pay-out tube for use in conjunction with a cable container that includes a cable retainer adapted to be disposed exteriorally of the cable container for receiving an end portion of the cable housed within the cable container and retaining the same. The cable retainer includes a surface or plate divided by one or more slits that form at least two sections with at least one of the two sections being deflectable and which deflects at least partially open in response to the end of the cable being inserted between the sections.

DETAILED DESCRIPTION OF THE INVENTION

Figure 1:
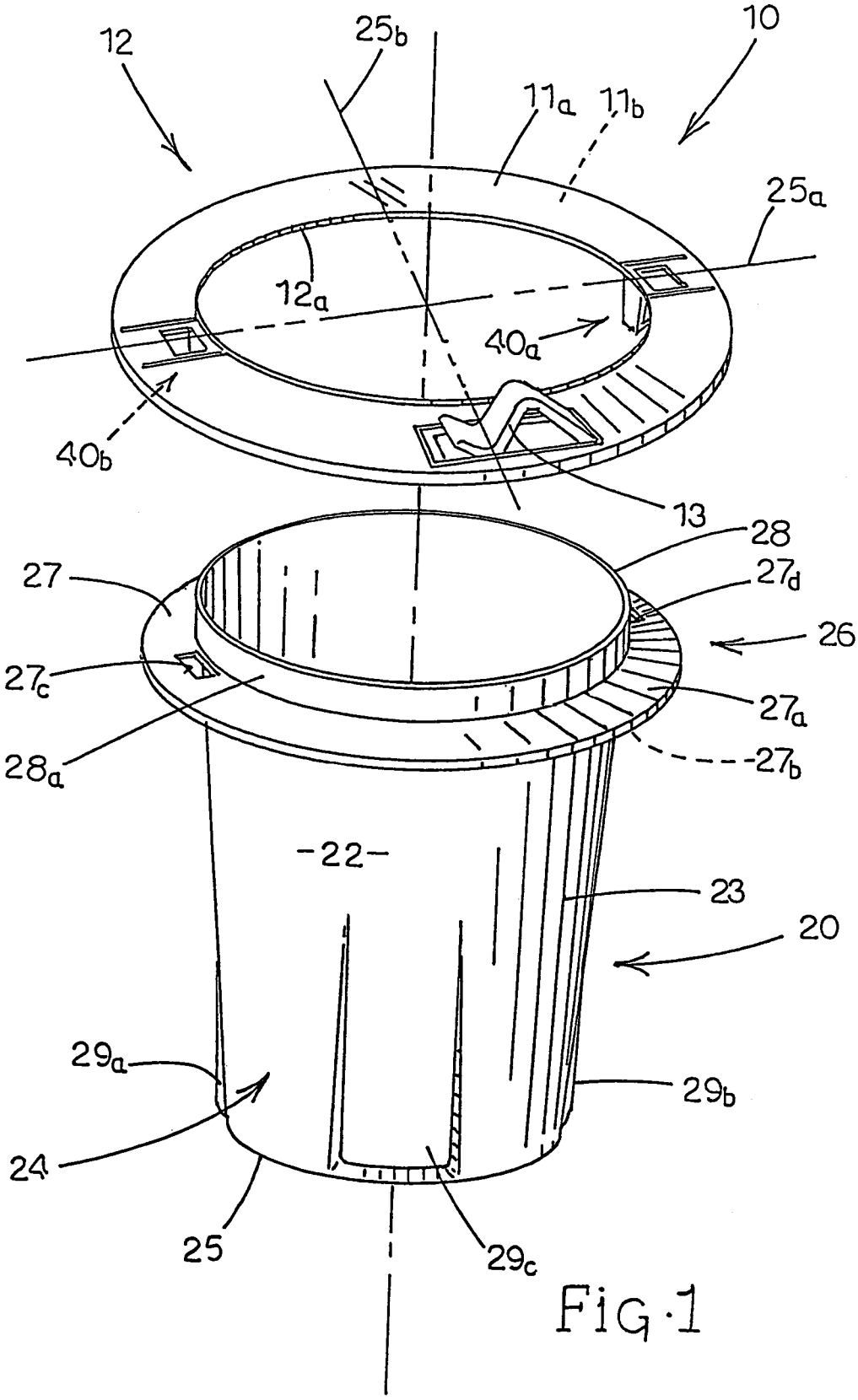
FIG. 1 is an exploded perspective view of the pay-out tube.
Figure 2:
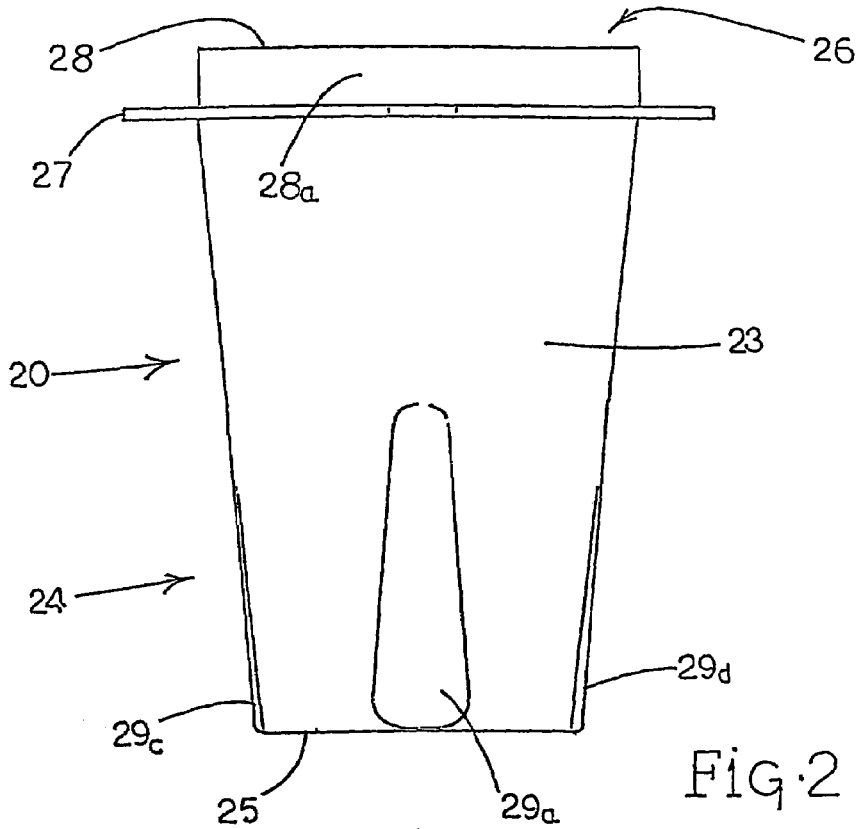
FIG. 2 is a side elevation view of the tube portion of the pay-out tube.

With further reference to the figures, and in particular FIG. 1, the pay-out tube is indicated generally by the numeral 10. Pay-out tube 10 is basically of a two-piece construction and includes a tube indicated generally by the numeral 20 and a collar indicated generally by the numeral 12.

Figure 3:
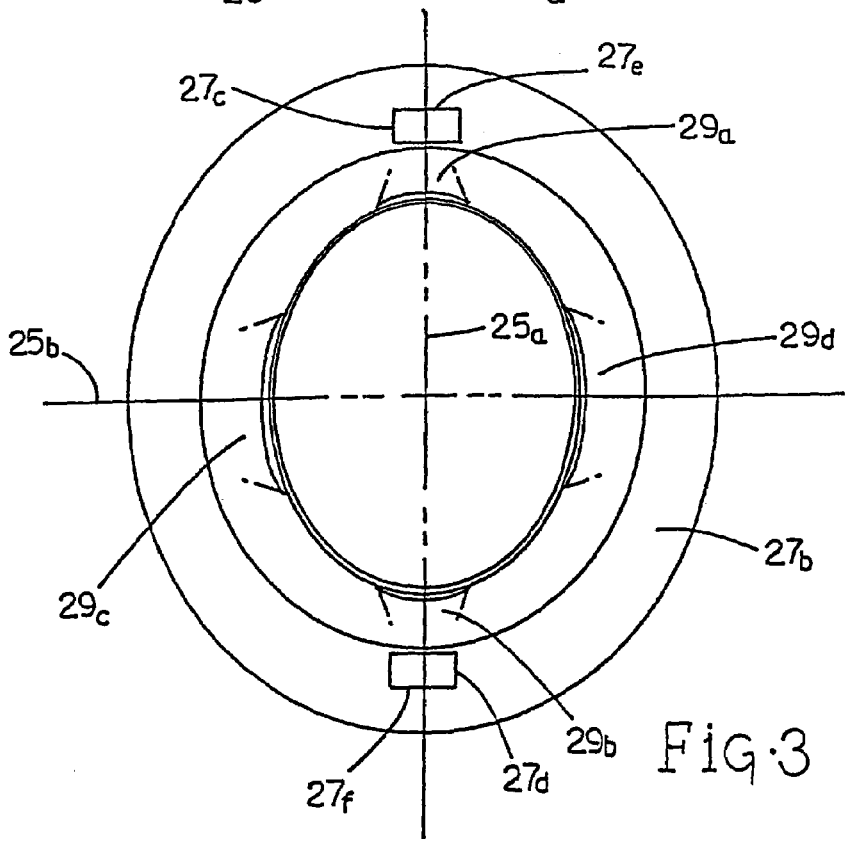
FIG. 3 is an inlet-end plan view of the tube portion.
Figure 4:
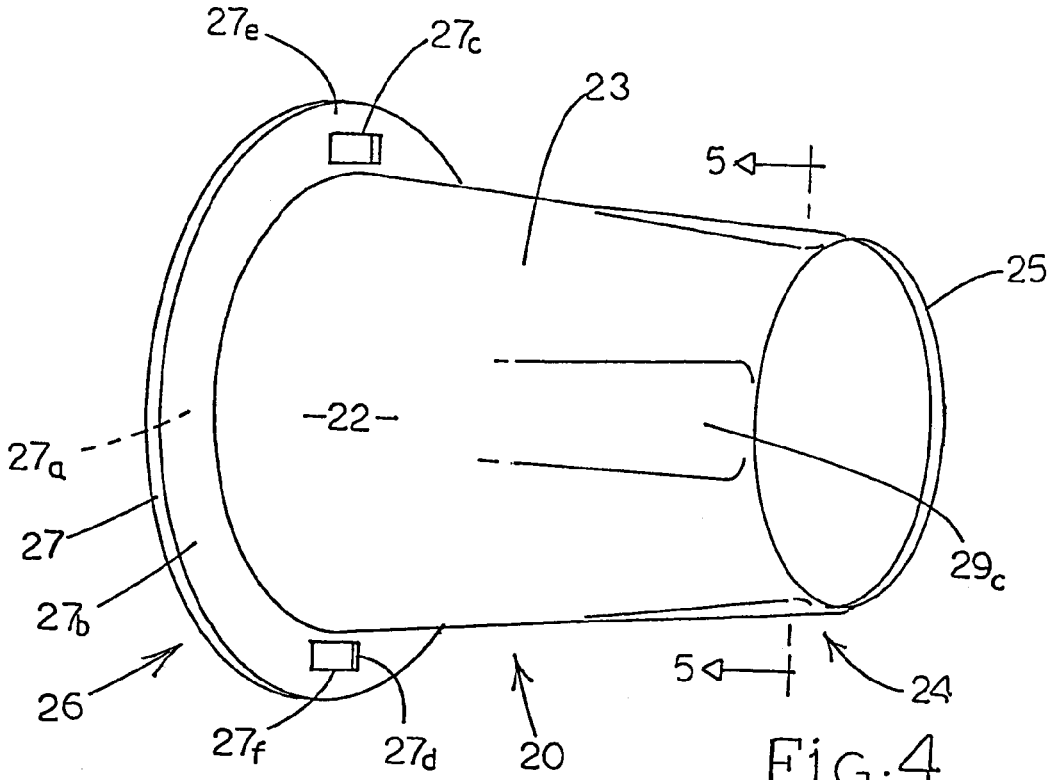
FIG. 4 is a perspective view of the tube.
Figure 5:
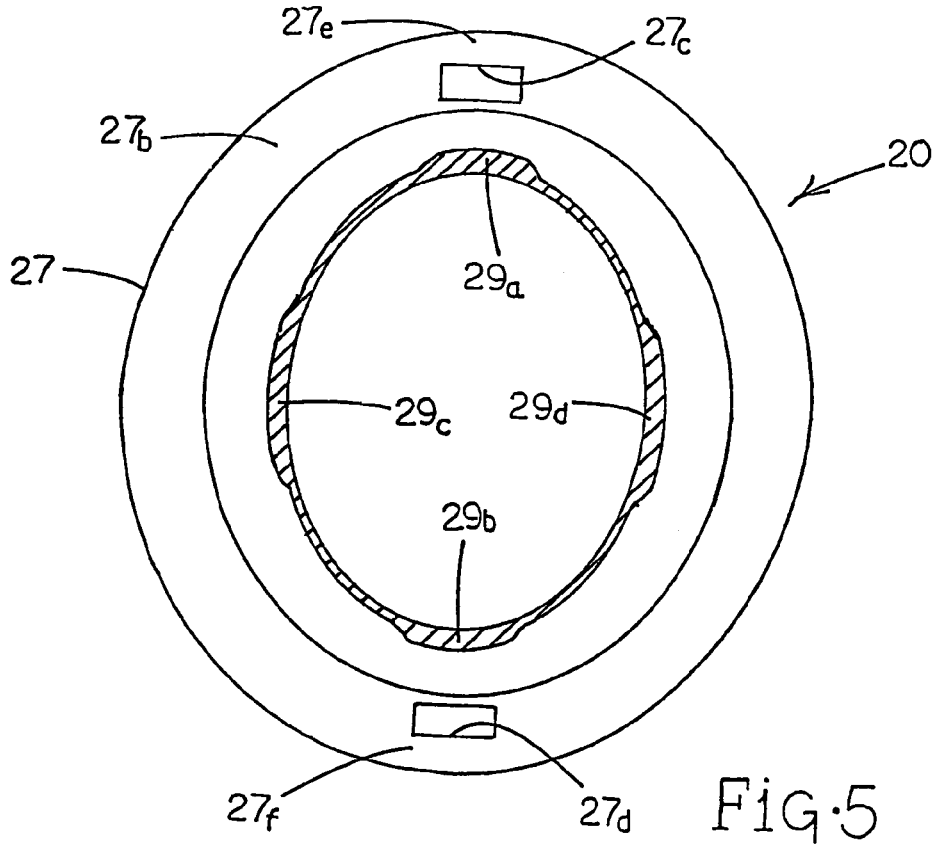
FIG. 5 is a sectional view of the tube taken through line 5—5 of FIG. 4.

Turning to tube 20, the same is comprised of an elongated and tapered tube with a generally elliptical cross sectional wall structure 22. Tube 20 includes an inlet end portion 24 including an inlet end 25, an intermediate portion 23, and an outlet end portion 26 including an outlet end 28. Tube 20 is tapered from outlet end 28 to inlet end 25 and has a generally elliptical cross section described by a major axis 25*a* and a minor axis 25*b* as can be seen in FIG. 3.

Turning more specifically to a description inlet end portion 24 of the tube 20, in addition to the elliptical shape of the cross section there exist four ribs 29*a*, 29*b*, 29*c*, and 29*d*. Each rib is reverse tapered relative to the taper of tube 20, and each rib extends from inlet end portion 24 to intermediate portion 23. Ribs 29*a* and 29*b* are circumferentially centered on major axis 25*a* and ribs 29*c* and 29*d* are similarly centered on minor axis 25*b* as can be seen in FIG. 3. The circumferential width of ribs 29*c* and 29*d* is somewhat greater than that of ribs 29*a* and 29*b*. Referring more specifically to the taper of the ribs, the circumferential width becomes narrower from inlet end portion 24 to intermediate portion 23. Similarly, the radial thickness of each rib becomes smaller from inlet end portion 24 to intermediate portion 23. The ribs are formed integrally with wall structure 22 so as to provide increased wall thickness in the areas of the ribs as compared to the remainder the wall structure.

Turning now specifically to outlet end portion 26, in addition to the generally elliptical cross-section there is disposed somewhat interior to outlet end 26 a flange 27. The section of outlet end portion 26 disposed between the flange 27 and the outlet end 28 forms an outlet end extension 28*a*.

Turning more specifically to flange 27, the same includes opposed surfaces 27*a* and 27*b*. Formed immediately adjacent to the wall structure 22 are two openings 27*c* and 27*d*, which are positioned generally opposite each other and centered on the major axis 25*a*. Disposed radially outward, adjacent to openings 27*c* and 27*d* and on surface 27*b* are two latch surfaces 27*e* and 27*f* (FIG. 3).

Turning now to collar 12, the same is an elliptical torus with a rectangular circumferential cross section and with a surface 11*a*, a surface 11*b*, and an interior opening 12*a*. Disposed diagonally opposite each other and along major axis 25*a* are two latches 40*a* and 40*b*. Disposed on surface 11*a*, aligned with the minor axis 25*b* is a clip 13.

Figure 6:
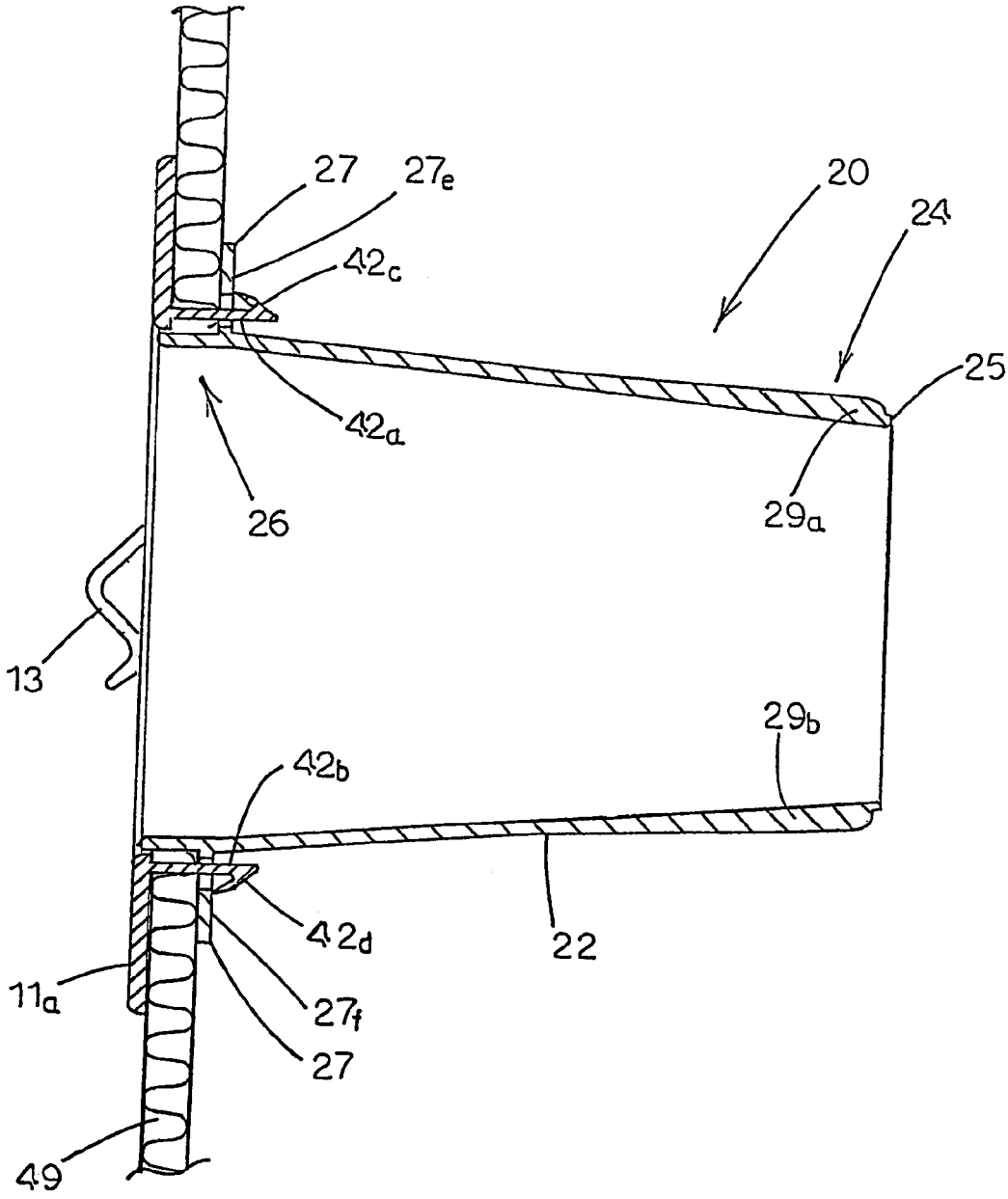
FIG. 6 is a sectional view of the pay-out tube shown assembled with a container.

Turning more specifically to latches 40*a* and 40*b* and as seen in FIG. 6, the latches are comprised of cantilevers 42*a* and 42*b* with tabs 42*c* and 42*d*. Each cantilever 42*a* and 42*b* is directed generally perpendicularly to surface 11*b* and biased slightly outward. Each tab 42*c* and 42*d* is directed at an angle outwardly and towards surface 11*b*.

Turning now specifically to clip 13, in a preferred embodiment a wire or cable clip 13 is integrally molded into the collar 12. Due to its construction and relationship to surface 11*a*, clip 13 is biased to assume a closed position.

Figure 7:
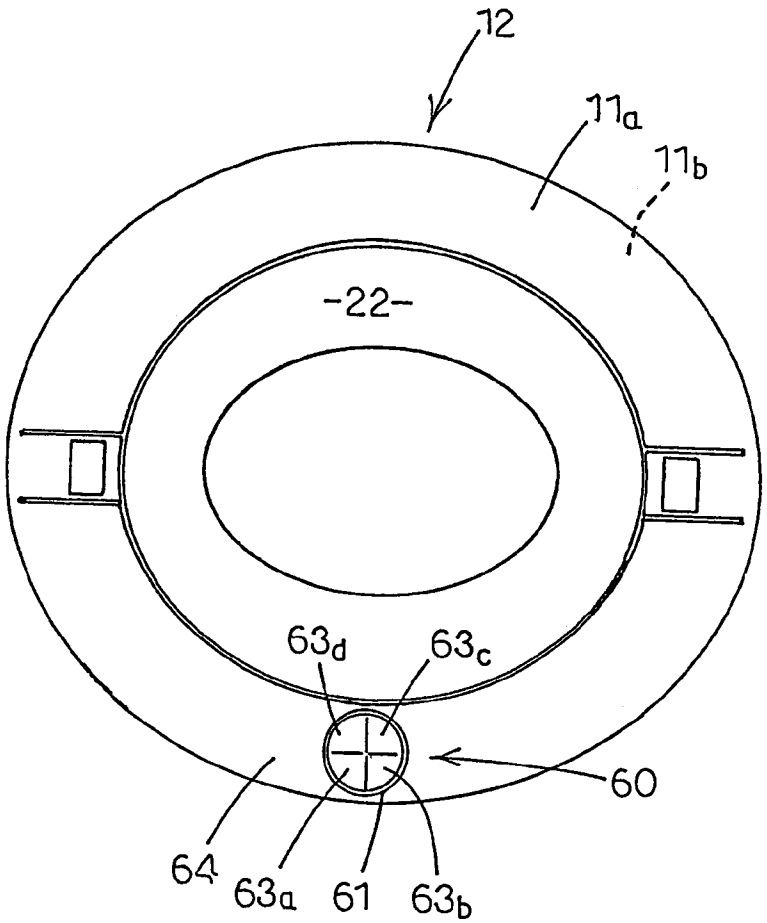
FIG. 7 is an outlet-end plan view of an alternative design of the collar for the pay-out tube.
Figure 8:
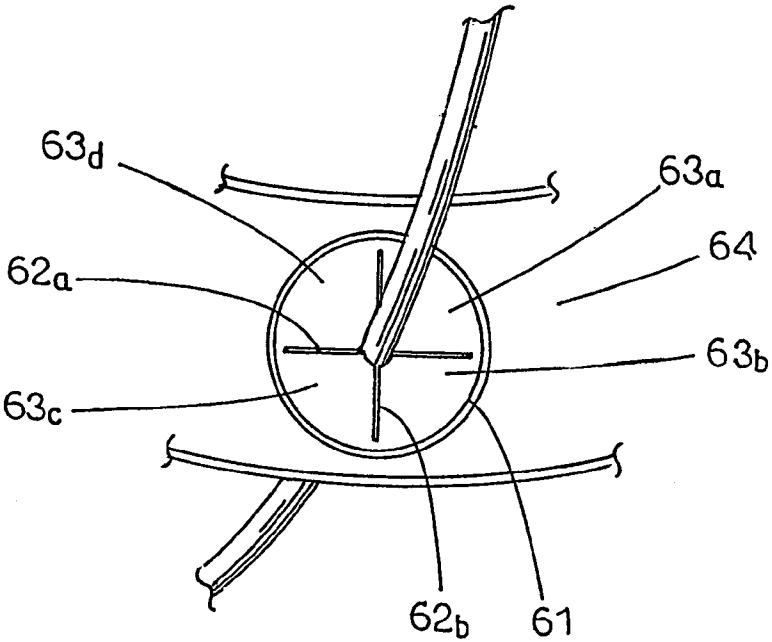
FIG. 8 is an enlarged perspective view illustrating the cable or wire retainer shown in FIG. 7.

Collar 12 may be provided with an alternative to clip 13. As seen in FIG. 7 and FIG. 8, disposed on collar 12 is a retainer 60. Retainer 60 is comprised of a membrane or surface 61 which is preferably molded integrally in, and is disposed in, a region located radially outward on collar 12. Surface 61 is segmented by slits 62*a* and 62*b* dividing plate 61 into segments 63*a*, 63*b*, 63*c*, and 63*d* which segments are somewhat less stiff than the surrounding region 64. To retain a cable or wire end within the retainer 60, an end portion of the cable or wire is inserted between or within one of the slits 62*a* and 62*b*. As the cable or wire end is pushed through the slit or slits, one or more of the segments or panels 63*a*, 63*b*, 63*c* and 63*d* will flex such that the wire or cable end can be inserted. The cable or wire end is retained by the friction or binding action of the segments on cables 63*a*, 63*b*, 63*c* and 63*d*. It is appreciated that the number of slits and panels may vary.

As shown in FIGS. 7 and 8, the retainer 60 is formed in the surrounding annular ring that forms the collar 12. When the pay-out tube 10 is secured to the container 49 as shown in FIG. 6, the connection is typically sufficiently loose to enable the cable or wire end extending through the retainer 60 to be pushed between the inner surface 11*b* of the collar 12 and the exterior of the wall of the container 49.

Turning now to the assembly of tube 20 and collar 12 to form pay-out tube 10, as seen in FIG. 6, tube 20 is positioned within a container 49. Moreover, also positioned within container 49 is a winding [not shown]. In conventional fashion, tube 20 is further inserted into a radial opening formed in the winding. Outlet extension 28*a* is extended through an opening in the wall of the container 49 such that flange 27 rests against the container wall. Collar 12 is positioned over outlet end extension 28*a* by aligning latches 40*a* and 40*b* with openings 27*c* and 27*d*. Then, movement of collar 12 towards flange 27 results in contact of tabs 42*c* and 42*d* with the outer edges of openings 27*c* and 27*d* and subsequent deflection of latches 40*a* and 40*b* inwardly as tabs 42*c* and 42*d* pass through openings 27*c* and 27*d*. Due to the outward bias of cantilevers 42*a* and 42*b*, as tabs 42*c* and 42*d* move through openings 27*c* and 27*d* latches 40*a* and 40*b* snap outward and tabs 42*c* and 42*d* lock against surfaces 27*e* and 27*f*. Payout tube 10 is thus affixed to the wall of container 49 by the resulting clamping of the container wall between collar 12 and flange 27.

Turning now to the operation of the invention, and referring specifically to FIG. 6, it is appreciated that a cable or wire is threaded from a winding within the container 49 into inlet end 25 and through outlet end 28 so that the cable end is disposed outside the container. To retain cable end when not dispensing, the cable end is passed under clip 13 and the cable is held in place by the binding action resulting from the bias of clip 13 towards surface 11*a*. In the alternative design, which employs retainer 60, the cable end is introduced into retainer 60 causing opening of one or more slits 62*a* and 62*b* due to deflection of one or more segments 63*a*, 63*b*, 63*c*, or 63*d* and allowing cable end to pass through slits 62*a* and 62*b*. The cable is held in place by the binding action of one or more segments 63*a*, 63*b*, 63*c*, and 63*d* against cable 52.

Pay-out tube 10 of the present invention can be constructed of molded polymer or any other suitable material. As articulated in the foregoing description, the pay-out tube of the present invention has many advantages over the prior art pay-out tubes in that it is easy to install, provides improved stability of the installation and dispensing operation, and provides means for conveniently affixing the terminal end of the cable when dispensing is not in progress.

The present invention may, of course, be carried out in other specific ways than those herein set forth without departing from the spirit and essential characteristics of the invention. The present embodiments are, therefore, to be considered in all aspects as illustrative and not restrictive, and all changes coming within the meaning and equivalency range of the appended claims are intended to be embraced therein.

What is claimed is:

1. A pay-out tube adapted to be operatively associated with a cable container through which cable from a winding disposed within the container is fed, comprising: a generally elliptically-shaped tube having a major axis, a minor axis, an outlet end portion, and an inlet end portion; a series of spaced-apart reinforcing ribs integrally formed in the inlet end portion of the tube and generally aligned with the major and minor axes of the tube; and wherein each rib assumes a longitudinal configuration and projects towards the outlet end portion of the tube, and includes a generally arcuate-shaped outer surface.

2. The pay-out tube of claim 1 wherein the tube includes an inlet end and wherein each reinforcing rib includes a width that becomes progressively wider towards the inlet end of the tube.

3. The pay-out tube of claim 1 wherein the tube includes an inlet end and wherein each rib includes first and second ends, the first end disposed adjacent the inlet end of the tube and the second end disposed adjacent an intermediate area of the tube, and wherein the thickness of the rib increases from the second end to the first end.

4. The pay-out tube of claim 1 wherein the tube includes inner and outer surfaces and wherein the reinforcing ribs rise outwardly from the outer surface of the tube.

5. The pay-out tube of claim 1 wherein the tube includes an inlet end and wherein each of the reinforcing ribs terminate short of the inlet end.

6. The pay-out tube of claim 1 wherein the tube includes a wall structure and an inlet end, wherein each reinforcing rib includes a pair of opposed ends, one end being disposed adjacent the inlet end of the tube and the other end being disposed adjacent an intermediate area of the tube, and wherein the end of the reinforcing rib disposed adjacent the intermediate area of the tube blends into the wall of the tube.

7. The pay-out tube of claim 1 including an outer locking plate adapted to be secured to the tube and about the outside of the cable container, and a cable retainer associated with the locking plate, the cable retainer including a slitted surface that defines at least two flexible sections and wherein an end portion of a cable can be inserted into the slitted surface and retained thereby.

8. The pay-out tube of claim 7 wherein the cable retainer comprises a membrane having the series of sections formed by at least two slits.

9. The pay-out tube of claim 8 wherein the membrane is confined within a generally circular area and includes at least four sections separated in part, at least by two criss-crossing slits.

10. A pay-out tube for use with a cable container and through which cable from a winding disposed within the container is fed, comprising:

a. a tube adapted to at least partially extend into the interior of the cable container for permitting cable disposed within the container to be fed through the tube and out of the container;

b. a fastener for securing the tube to the cable container, the fastener being adapted to be secured to the tube such that at least a portion thereof lies exterior of the cable container; and c. a cable retainer adapted to be disposed exteriorly of the cable container for receiving an end portion of the cable housed within the cable container and retaining the same, the cable retainer including a surface divided by one or more slits that form at least two sections with at least one of the two sections being deflectable and which deflect at least partially open in response to the end of the cable being inserted between the sections.

11. The pay-out tube of claim 10 wherein the slitted surface forms a membrane having a series of deflectable sections.

12. The pay-out tube of claim 11 wherein the membrane includes at least four deflectable sections formed by cross-slits.

13. The pay-out tube of claim 12 wherein the membrane is surrounded by a perimeter material more rigid than the material forming the sections of the membrane.

14. A pay-out tube for use with a cable container and through which cable from a winding disposed within the container is fed, comprising: a molded tube portion for receiving and guiding cable from the interior of the cable container to the exterior of the cable container, wherein the tube portion assumes a generally elliptical configuration having major and minor axes; and the tube portion including a surrounding wall having a thickness and a series of spaced-apart, nonintersecting ribs integrally molded into the wall and extending from the wall such that a thickness of the individual ribs exceeds the thickness of the wall; and wherein there is provided at least four ribs with the individual ribs being aligned with the major and minor axes of the tube.

15. The pay-out tube of claim 14 wherein the ribs are longitudinally disposed on the wall of the tube.

16. The pay-out tube of claim 14 wherein the wall of the tube includes inner and outer surfaces and wherein the individual ribs extend outwardly from the outer surface of the wall.

17. The pay-out tube of claim 14 wherein each rib includes opposed ends wherein the thickness of the ribs vary from one end to the other.

18. A pay-out tube and cable retainer for use with a cable container adapted to house a cable winding, comprising: a pay-out tube adapted to receive cable from the winding and guide the cable from an area interior of the cable container to an area exterior of the cable container; a cable retainer associated with the pay-out tube for receiving and retaining an end portion of a cable exteriorly of the cable container; and the cable retainer including a surface having at least one slit formed therein that defines two sections, at least one section being deflectable and which opens in response to the cable being inserted between the two sections permitting the cable to be moved between the two sections and be held by the two sections.

19. The pay-out tube and cable retainer of claim 18 wherein the cable retainer includes a membrane having at least four deflectable sections formed by a pair of cross-slits.

20. The pay-out tube and cable retainer of claim 19 wherein the membrane is formed interiorly of a perimeter and wherein the material comprising the four sections of the cable retainer are less rigid than material lying outwardly of the perimeter.

* * * * *